United States Patent [19]

Harmelink

[11] Patent Number: 5,038,587

[45] Date of Patent: Aug. 13, 1991

[54] CONTROL SYSTEM

[75] Inventor: Gregory K. Harmelink, Newton, Iowa

[73] Assignee: Maytag Corporation, Newton, Iowa

[21] Appl. No.: 560,072

[22] Filed: Jul. 27, 1990

Related U.S. Application Data

[63] Continuation-in-part of Ser. No. 495,025, Mar. 16, 1990, Pat. No. 5,001,910.

[51] Int. Cl.[5] ..... D06F 33/02; D06F 39/14

[52] U.S. Cl. ..... 68/12.26; 68/12.06; 292/DIG. 69

[58] Field of Search ..... 68/12.01, 12.06, 12.26; 292/DIG. 69; 134/57 DL, 58 DL; 200/61.62

[56] References Cited

U.S. PATENT DOCUMENTS 3,111,830 11/1963 Low .
3,122,009 2/1964 Jarvis .
4,510,777 4/1985 Ellingson et al. ..... 68/12.26
4,866,955 9/1989 Blair et al. .

*Primary Examiner*—Philip R. Coe

*Attorney, Agent, or Firm*—Richard L. Ward; Allan P. Orsund

[57] ABSTRACT

A control system is provided for a fabric washing machine including a controller for controlling the machine through a predetermined cycle of operations and having a first state at which the cycle may be initiated and a second state at the end of the cycle. A lid actuated switch is in circuit with a power supply and the controller and is operable between first and second conductive postures by movement of the lid. First circuitry is connected to the first conductive posture of the switch for energizing the controller in the first state to control the machine through the cycle and terminate operation at the second controller state at the end of the cycle. Second circuitry is connected to the second conductive posture of the switch and is operable with the controller in the second state for initiating modification of the controller to the first state to condition the controller for initiation of a new cycle of operations. Operability of the switch to the second conductive posture is a prerequisite to initiating a new cycle of operations.

8 Claims, 5 Drawing Sheets

CONTROL SYSTEM

CROSS REFERENCE TO RELATED APPLICATIONS

This application is a continuation-in-part of pending application Ser. No. 07/495,025 filed Mar. 16, 1990, and now Pat. No. 5,001,910.

BACKGROUND OF THE INVENTION

This invention relates generally to a control system for use with a fabric washing machine and in particular to a control system for checking the operability of a control switch in a fabric washing machine where the timer is not manually advanced through any part of its cycle of operations.

In the operation of both domestic and commercial fabric washing machines and fabric drying machines, it has been generally common practice for those machines with electromechanical timers to provide a timer knob extending forwardly through the control panel. The timer knob can be manually operated by the machine user to position the timer at a cycle start posture or to advance the timer through a particular portion of a cycle of operations.

Some commercial machines such as Low, U.S. Pat. No. 3,111,830, show a clothes washing machine without a protruding timer knob wherein the entire machine is shut down when the lid is opened at the start of or during wash spin and only the drive motor is shut down as the lid is opened during rinse spin allowing the timer motor to run through the cycle. Subsequent operation of the coin slide initiates a new timing cycle by indexing the timer cams to the start position. Further, Jarvis, U.S. Pat. No. 3,122,009, provides a safety interlock control system which assures that when the access door to the wash basket is opened before the end of a cycle, the basket will be stopped but the timer device will time out to the end of a normal cycle. The timing out will occur without causing any of the remaining cycle operations to occur. The machine is then conditioned for a new cycle of operation by the insertion of a predetermined number of coins. While these prior art machines provide for timing out to the end of a cycle if the lid is prematurely opened, there is no provision for checking the operability of a lid actuated switch and automatically conditioning the timer for initiating a new cycle of operations after confirming the operability of the lid actuated switch and preventing the conditioning if the lid actuated switch is failed.

Ellingson et al, in U.S. Pat. No. 4,510,777, disclose a washing machine having a microcontroller based program means. The washing machine has a door latching mechanism that must be actuated to lock the access door to the closed posture prior to a cycle of operations. Before initiating a cycle a normally opened low voltage lock switch is checked by the microcontroller to insure that its contacts are open. Once the contacts of the low voltage switch are verified open, a solenoid is energized for pivoting the access door latch lever to close the contacts of the low voltage lock switch and complete a circuit path to ground. This circuit path to ground indicates to the microcontroller that the lock switch is operable and that the access door has been closed and locked. If the access door is not closed, operation of the latching mechanism will be blocked preventing closure of the contacts of the lock switch. This will prevent completion of the circuit path to ground and indicate to the microcontroller that the access door is not in a lockable position. Also, Blair et al in U.S. Pat. No. 4,866,955, disclose monitoring of a high voltage line switch by a microcontroller and preventing operation of the appliance if the switch has not cycled between open and closed posture at the completion of a cycle.

There has been no provision of a control and switch checking system for a fabric washing machine, where the electromechanical timer cannot be manually advanced, which provides for the automatic conditioning of the timer for initiating a new cycle of operations and for confirming the operability of a lid actuated switch.

SUMMARY OF THE INVENTION

It is therefore an object of the instant invention to provide an improved control system for a fabric washing machine.

It is a further object of the instant invention to provide a control system for a fabric washing machine having a timer which is not manually advanceable and wherein the timer is automatically conditioned for initiating a new cycle of operations only when the lid switch operability is confirmed.

It is a still further object of the instant invention to provide a control system for a fabric washing machine wherein the non-manual, automatic conditioning of the timer for actuation of a cycle of operations is dependent on operation of the lid switch from a first conductive posture to a second conductive posture.

Briefly, the instant invention achieves these objects in a control system for a fabric washing machine having a movable lid for providing access to a tub assembly. A program controller controls the fabric washing machine through a predetermined cycle of operations. The program controller has a first state at which the cycle of operations may be initiated and a second state upon completion of the cycle of operations. The control system includes a power supply for the fabric washing machine including the program controller. Switch apparatus is in circuit with the power supply and the program controller. The switch apparatus is actuatable between a first conductive posture with the lid in a first condition and a second conductive posture with the lid in a second condition. A first circuit is connected with the first conductive posture for energizing the program controller in the first state to control the fabric washing machine through the cycle of operations and to terminate operation thereof with the program controller in the second state upon completion of the cycle of operations. A second circuit is connected to the second conductive posture and is operable with the program controller in the second state and the lid in the second condition for initiating modification of the program controller to condition the program controller for initiation of a new cycle of operations. Operability of the switch apparatus to the second conductive posture is a prerequisite to initiating a new cycle of operations.

Operation of the control system and further objects and advantages thereof will become evident as the description proceeds and from an examination of the accompanying five sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
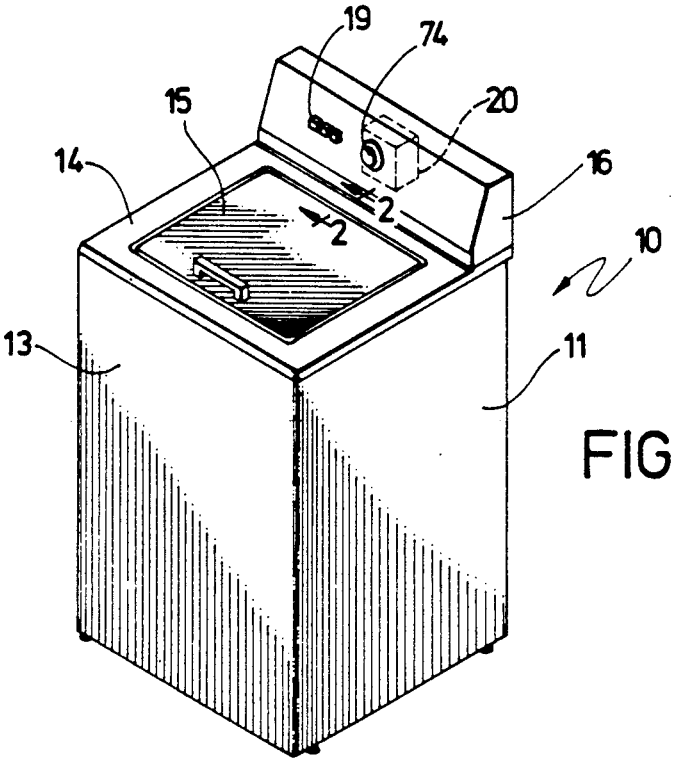
FIG. 1 is an isometric view of a fabric washing machine including a control system having a timer with control knob.
Figure 2:
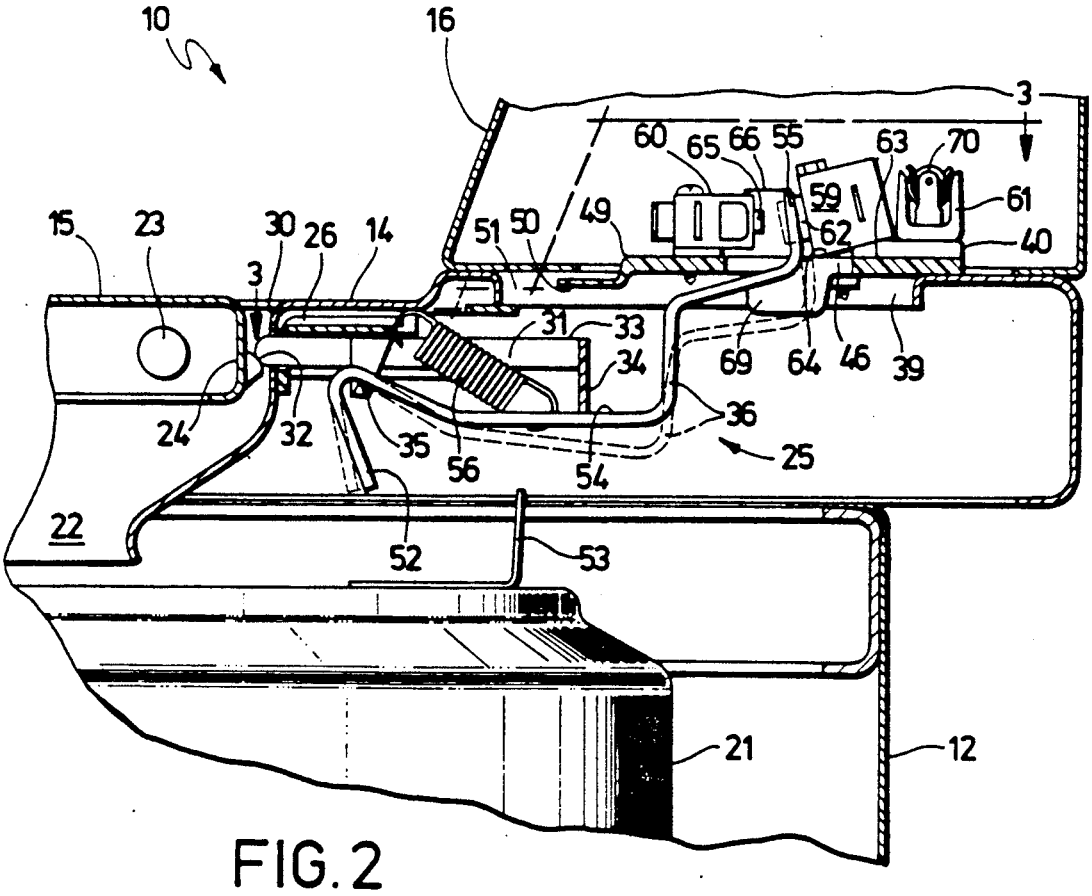
FIG. 2 is a partial fragmentary section view taken generally along lines 2—2 of FIG. 1.

Referring now to the drawings and to FIGS. 1 and 2 in particular, there is shown an automatic fabric washing machine 10. The automatic fabric washing machine 10 is housed within a generally rectangular cabinet having a three-sided enclosure forming the sides 11 and rear 12 of the cabinet. A substantially vertically oriented front panel 13 completes the peripheral cabinet of the fabric washing machine 10. The cabinet of the fabric washing machine 10 further includes a generally horizontally disposed top cover 14 incorporating a pivotable access door or lid 15 for providing access to the interior of the fabric washing machine 10. A control housing 16 extends generally upward from the rear of the top cover 14 and houses miscellaneous controls such as selection switches 19 and in this embodiment an electromechanical timer 20, shown in dashed lines in FIG. 1, for controlling the sequential operation of the fabric washing machine 10 through a plurality of events such as filling the tub 21 with washing fluid, dispensing detergent and/or bleach, agitation, washing fluid extraction, and rinsing which comprise a predetermined cycle of operations. As best shown in FIG. 2, the top cover 14 includes an access opening 22 through which fabrics may be inserted into or removed from the tub 21. The access opening 22 is closed by the access door or lid 15 which is pivoted about a fulcrum 23 spaced a short distance from the rear end 24 of the lid 15. The rear end 24 of the lid 15 functions as a lever with respect to the fulcrum 23 for engaging the switch actuating and unbalance mechanism 25.

Figure 4:
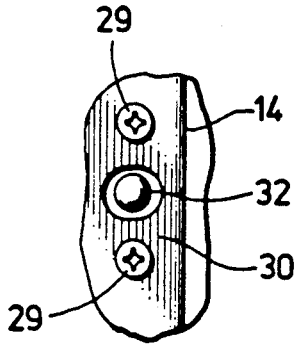
FIG. 4 is a fragmentary view taken generally along lines 4—4 of FIG. 3 showing the attachment of a frame portion of the lid actuating mechanism to the top cover of the fabric washing machine.

The switch actuating and unbalance mechanism 25 has a molded plastic frame 26 which is attached to the underside of the top cover 14 by a pair of screws 29, as best shown in FIG. 4, which extend through a substantially vertical wall 30 associated with the access opening 22 of the top cover 14 and thread into the frame 26. A plunger 31 is slidingly supported within the frame 26. The front end 32 of the plunger 31 is in the form of a projecting nose which extends generally horizontally through the vertical wall 30 associated with the access opening 22 of the top cover 14 and contacts the rear end 24 of the lid 15. The frame 26 is generally hollow and supports the plunger 31 for substantially horizontal sliding movement to the right and/or left depending on the posture of the lid 15. The rear end 33 of the plunger 31 has a downwardly extending flange 34 which contacts and slides relative to the horizontally extending portion 54 of the unbalance mechanism 25. The plunger 31 further includes an undercarriage 35 for pivotally supporting the combination unbalance lever and lid switch actuator 36 on the plunger 31 and which will be further described herein.

Figure 3:
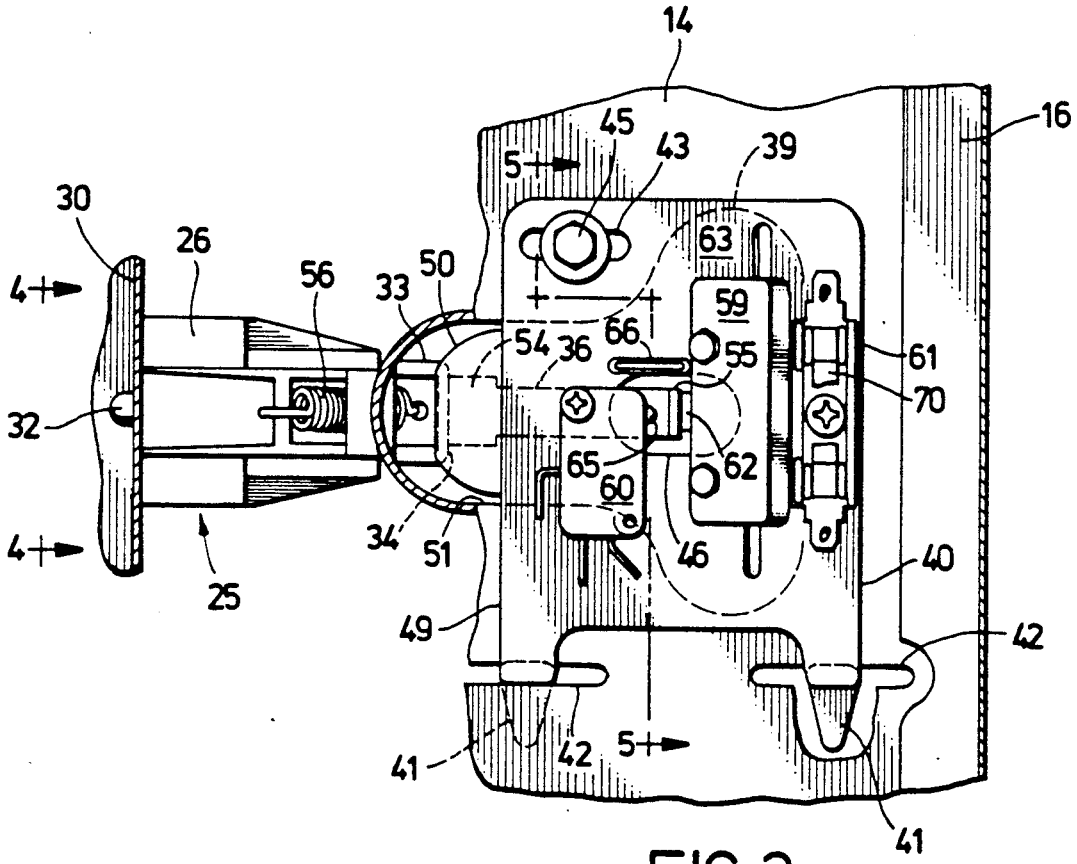
FIG. 3 is a partial fragmentary section view taken generally along lines 3—3 of FIG. 2.

As best shown in FIGS. 2 and 3, the top cover 14 has a downwardly formed generally T-shaped opening 39 spaced rearwardly from the access opening 22 and axially aligned with the switch actuating and unbalance mechanism 25. The T-shaped opening 39 is covered by the control housing 16 when it is fastened to the top cover 14. The T-shaped opening 39 serves first as a hand-hold for handling the top cover 14 during manufacturing operations and when assembled as part of the fabric washing machine 10 provides an opening between the interior of the control housing 16 and the interior of the fabric washing machine 10.

Figure 5:
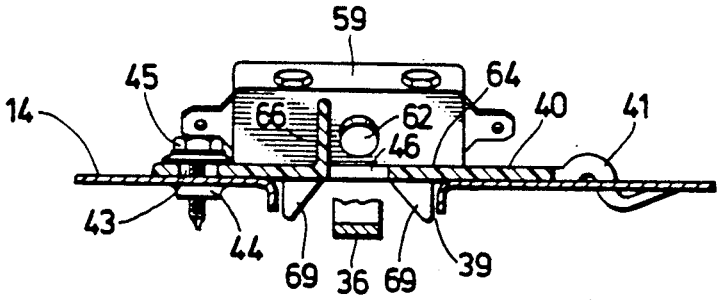
FIG. 5 is a fragmentary view taken generally along lines 5—5 of FIG. 3.

As further shown in FIGS. 2, 3, and 5, a generally rectangular switch mounting bracket 40 is secured to the top cover 14 so that it substantially overlies the T-shaped opening 39. As best shown in FIG. 3, one side of the switch mounting bracket 40 includes a pair of spaced-apart downwardly extending tabs 41 which are received by a pair of slots 42 formed in the top cover 14. The pair of slots 42 are generally parallel with the front-to-rear axis of the switch actuating and unbalance mechanism 25 and permit the switch mounting bracket 40 to move in a sliding fashion a predetermined front-to-rear distance upon the top cover 14. The opposite side of the switch mounting bracket 40 has a slot 43 which is generally parallel to the pair of slots 42 in the top cover 14. The slot 43 in the switch mounting bracket 40 overlies an extruded aperture 44 in the top cover 14, as best shown in FIG. 5, which receives a locking fastener 45 for securing the switch mounting bracket 40 to the top cover 14.

The central portion of the switch mounting bracket 40 further includes an opening 46 which is axially aligned with the front-to-rear path of the unbalance lever and lid switch actuator 36. As again shown in FIGS. 2 and 3, the forward edge 49 of the switch mounting bracket 40 has a forwardly extending tongue 50 which, as best shown in FIG. 2, rides in the narrowed front-to-rear portion 51 of the T-shaped opening 39 to reduce twisting movement of the switch mounting bracket 40 during sliding movement thereof with respect to the top cover 14. The tongue 50 substantially fills the narrowed front-to-rear portion 51 of the T-shaped opening 39 and with the main body of the switch mounting bracket 40 provides a vapor barrier between the control housing 16 and the interior of the fabric washing machine 10.

As previously described and as shown in FIG. 2, the unbalance lever and lid switch actuator 36 is pivotally supported by the undercarriage 35 of the plunger 31 and includes a depending lever 52 extending substantially downward from the pivot connection between the unbalance lever and lid switch actuator 36 and the plunger 31. The depending lever 52 is positioned for engagement by the bumper 53 upon excessive gyration of the tub 21 to pivot the unbalance lever and lid switch actuator 36 downwardly to the dashed line posture shown in FIG. 2 for interrupting operation of the fabric washing machine 10. The unbalance lever and lid switch actuator 36 further includes a horizontally extending portion 54 having an upturned end 55 which extends angularly upward and to the right in FIG. 2 through the T-shaped opening 39 in the top cover 14 and through the opening 46 in the switch mounting bracket 40. As the access door or lid 15 is closed and opened, the unbalance lever and lid switch actuator 36 is moved a predetermined linear rearward and forward distance respectively.

A biasing spring 56 is operably disposed between the unbalance mechanism frame 26 and the unbalance lever and lid switch actuator 36. This biasing spring 56 provides upwardly and forwardly directed components of biasing force. The upwardly directed component of force maintains the horizontally extending portion 54 of the unbalance lever and lid switch actuator 36 against the rear flange 34 of the plunger 31. The forwardly directed component of force biases the unbalance lever and lid switch actuator 36 and the plunger 31 in a forward direction to maintain engagement of the nose of the plunger 31 with the rear end 24 of the access door or lid 15.

The switch mounting bracket 40 is designed to rigidly mount a pair of switches 59 and 60 and a fuse holder 61. A single-pole single-throw lid switch 59 is secured to the switch mounting bracket 40 overlying the opening 46. The actuator button 62 of the lid switch 59 is juxtaposed to the upturned end 55 of the unbalance lever and lid switch actuator 36. The lid switch 59 is mounted to the switch mounting bracket 40 with the actuator button 62 tilted at an angle with respect to the top surface 63 of the switch mounting bracket 40. The angular mounting tilts the lower front edge 64 of the lid switch 59 with respect to the upturned end 55 of the unbalance lever and lid switch actuator 36. Thus, there will be no interference with the lower front edge 64 of the lid switch 59 after an unbalance situation in which the unbalance lever and lid switch actuator 36 have been pivoted below the switch mounting bracket 40. A single-pole double-throw switch 60 is mounted forwardly of the lid switch 59 and also overlies the opening 46 in the switch mounting bracket 40. The actuator button 65 of the switch 60 is juxtaposed the opposite side of the upturned end 55 and faces the actuator button 62 of the lid switch 59.

It is noted, with respect to FIGS. 2 and 3, that the facing switch actuator buttons 62 and 65 are a fixed horizontal distance apart. As best shown in FIG. 2, the switch actuator buttons 62 and 65 are arranged at different heights with respect to the top surface 63 of the switch mounting bracket 40 to insure that the unbalance lever and lid switch actuator 36 will properly move upward between the switches 59 and 60 as the lid 15 is raised and then lowered after an unbalance situation.

As best shown in FIG. 5, an upwardly extending wall 66 is located to the left of the opening 46 for protecting the actuator buttons 62 and 65 of the switches 59 and 60 from interference with miscellaneous wires. As further shown in FIG. 5, a pair of downwardly extending guides 69 are molded alongside the opening 46 in the switch mounting bracket 40. The guides 69 are tapered towards the opening 46 in the switch mounting bracket 40 to guide the unbalance lever and lid switch actuator 36 toward the opening 46.

The switch mounting bracket 40 with the rigidly mounted switches 59 and 60 is slidable on the top cover 14 to provide for simultaneous adjustment of the switches 59 and 60 with respect to the upturned end 55 of the unbalance lever and lid switch actuator 36. In normal operation, it is desired that the lid switch 59 open first as the lid 15 is opened. Also, the lid switch 59 should be the last to close as the lid 15 is closed. Adjustment of the switch mounting bracket 40 is thus made primarily with respect to the lid switch 59. The switch mounting bracket 40 is moved with respect to the slots 42 so that there is continuity across the lid switch 59 with the correct opening between the front edge of the lid 15 and the top cover 14. In this posture, the switch 60 will be closed to contact 84 to permit operation of the fabric washing machine 10.

It is further shown in FIGS. 2 and 3 that the switch mounting bracket 40 mounts a fuse holder 61. The fuse holder 61 is conveniently positioned behind the lid switch 59 and is thus located for easy accessibility if replacement of the fuse 70 is required.

Figure 6:
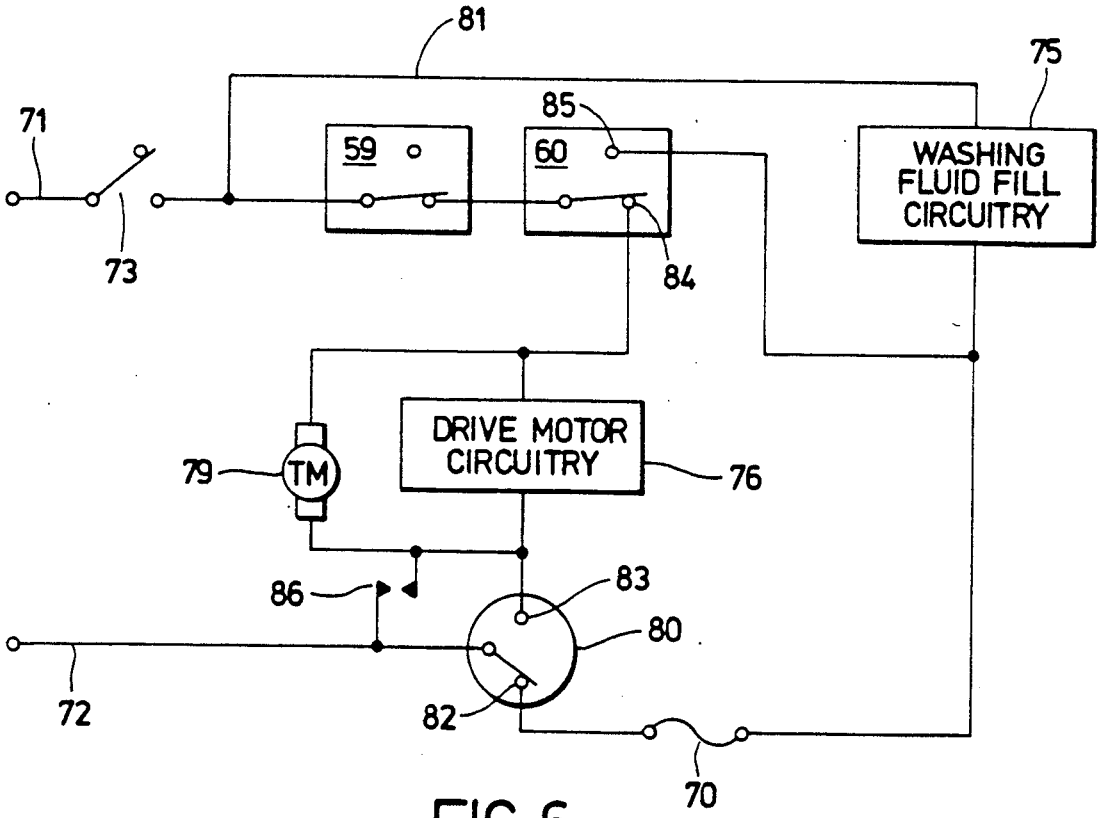
FIG. 6 is a partial electrical schematic drawing of the operational circuitry of the fabric washing machine shown in FIG. 1.

Turning now to FIG. 6, there is shown a partial schematic drawing of the lid switch circuit of one embodiment. The circuit includes a source of power as provided by standard 120 VAC between conductors 71 and 72 and commonly available in most households. A line switch 73 is incorporated in the internal circuitry of the electromechanical timer 20 and is operated by manipulating the timer control knob 74. The circuit further includes the single-pole single-throw lid switch 59, the single-pole double-throw switch 60, washing fluid fill circuitry 75, drive motor circuitry 76, a timer drive motor 79, a pressure actuated washing fluid level switch 80 and a fuse 70.

The washing fluid fill circuitry 75 shown in block form in FIG. 6 comprises hot and cold washing fluid valves, switches for providing various combinations of hot and cold washing fluid and various timer switches operated by timer cams driven by the timer drive motor 79. The drive motor circuitry 76 also shown in block form comprises the drive motor start and run windings, speed switch, overload protector and various timer switches operated by timer cams driven by the timer drive motor 79.

The circuitry of FIG. 6 is arranged so that when the line switch 73 is closed but the lid 15 is open, the lid switch 59 will be in the non-conductive posture. A circuit will be completed by way of an internal timer bus connection 81 to the washing fluid fill circuitry 75 and if the washing fluid level switch 80 is made to the empty or fill contact 82, the circuit will be completed to conductor 72 of the power supply and the fabric washing machine 10 will fill with washing fluid with the lid 15 either open or closed. Energization of the drive motor circuitry 76 and energization of the timer drive motor 79 cannot occur until the washing fluid level switch is made to the full contact 83 as the fill is completed and the lid 15 is closed to actuate the lid switch 59 to the conductive posture and to actuate the switch 60 to the first conductive posture at contact 84.

During normal operation of the fabric washing machine 10, a cycle of operations can be interrupted at any point by merely opening the lid 15 to move the unbalance lever and lid switch actuator 36 in the forward direction to first actuate the lid switch 59 to the non-conductive posture. The act of opening the lid 15 will also normally actuate the switch 60 to the second conductive posture at contact 85 which, as shown in FIG. 6, bypasses the washing fluid fill circuitry 75 and is in series circuit connection with the fuse 70 and the empty or fill contact 82 of the washing fluid level switch 80. In the event that the lid switch 59 is welded or otherwise fixed in the closed posture when the lid 15 is opened with tub 21 empty, a circuit is completed from conductor 71, through the line switch 73, through the failed closed lid switch 59, through the switch 60 made to the second conductive posture at contact 85, through the fuse 70 and through the empty or fill contact 82 of the washing fluid level switch 80 to conductor 72. This will cause full line current to pass through the fuse 70 and will quickly destroy the fuse 70 to disable the fabric washing machine 10 and prevent the next fill of washing fluid.

If the lid switch 59 is welded and the lid 15 is opened during the cycle when the tub 21 is full of washing fluid and the full contact 83 of the washing fluid level switch 80 is made, a circuit to the fuse 70 will not be completed since the washing fluid level switch 80 is made to the full contact 83. In this case, the switch 60 will, in effect, act as a back-up lid switch and will interrupt the cycle of operations since power is discontinued to the drive motor circuitry 76 and timer drive motor 79. As further shown in FIG. 6, a cam actuated timer switch 86 is open during fill and closed during spin or washing fluid extraction portions of a cycle. Thus, a bypass circuit is provided around the washing fluid level switch 80 for independent operation of the drive motor circuitry 76 so that the drive motor circuitry 76 and timer drive motor 79 do not operate through the full contact 83.

The circuit through the fuse 70 can only be completed, in this embodiment, when the washing fluid level switch 80 is made to the empty or fill contact 82 such as after a fluid extraction portion of a cycle and at the end of a cycle of operations. Then, when the lid 15 is opened with the lid switch 59 welded or failed in the conductive posture, the fuse 70 will be destroyed and the fabric washing machine 10 will be disabled. This disablement will require that the fabric washing machine 10 be serviced to replace the faulty lid switch 59 and the destroyed fuse 70.

During an unbalance situation where the bumper 53 has moved the unbalance lever and lid switch actuator 36 to the dashed line posture of FIG. 2, the lid switch 59 will be opened to the non-conductive posture but the switch 60 will remain in the first conductive posture at contact 84. The unbalance mechanism 25 is reset by opening and closing the lid 15 which will close the lid switch 59 to the conductive posture and allow the cycle of operations to continue.

Figure 7:
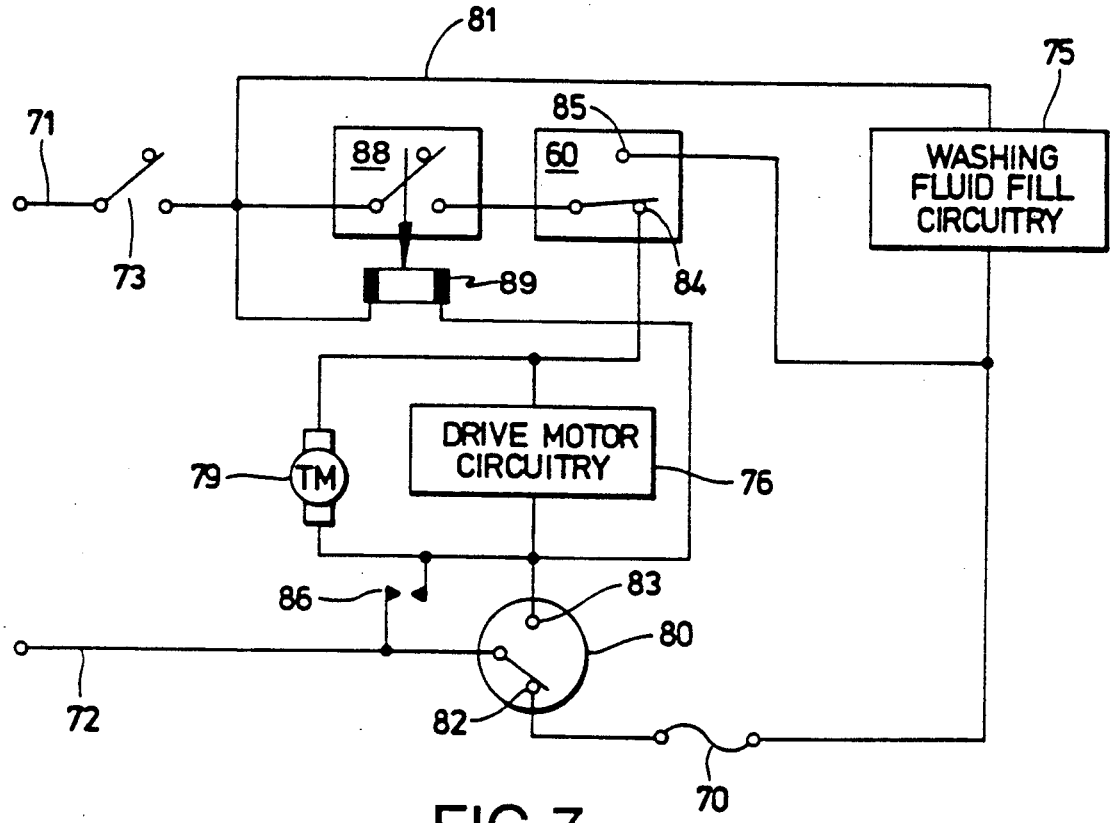
FIG. 7 is a schematic drawing of the operational circuitry of an alternate embodiment.

Referring now to FIG. 7, there is shown another circuit embodiment. In this embodiment, closing the line switch 73 with the control knob 74 will allow the fabric washing machine 10 to fill with the lid 15 either open or closed in a circuit similar to that shown in FIG. 6. Energization of the drive motor circuitry 76 and energization of the timer drive motor 79 cannot occur until the washing fluid level switch 80 is made to the full contact 83 as the fill is completed and the lid 15 is closed to operate the switch 60 to the lid-closed first conductive posture at contact 84. Once the fluid level switch 80 is made to the full contact 83, an electromechanical actuator such as a solenoid 89 is energized to close switch 88 which may be located away from the switch mounting bracket 40. A lid latching mechanism including a switch operating solenoid as in the alternate embodiment of FIG. 7 is fully described in U.S. Pat. No. 4,623,179 issued Nov. 18, 1986 to Davis et al and assigned to the assignee of the present invention. Closing switch 88 will complete a circuit to the drive motor circuitry 76 through switch 60 made to lid-closed contact 84 to permit operation of the fabric washing machine 10. It is anticipated, in the circuit of FIG. 7, that the solenoid 89 may be utilized to operate a lid latching mechanism as shown and described in U.S. Pat. No. 4,623,179 in addition to operating switch 88 to the conductive posture as the tub 21 is filled.

Once again, if switch 88 is welded or otherwise fixed in the closed posture with the lid 15 open and with tub 21 empty, a circuit will be completed as previously described for FIG. 6. Specifically, the circuit extends from conductor 71, through the line switch 73, through the switch 88, through the switch 60 made to the lid-open second conductive posture at contact 85, through the fuse 70 and through the empty or fill contact 82 of the washing fluid level switch 80 to conductor 72. This will again permit full line current to pass through fuse 70 for disabling the fabric washing machine 10 and preventing the next fill of washing fluid.

Figure 8:
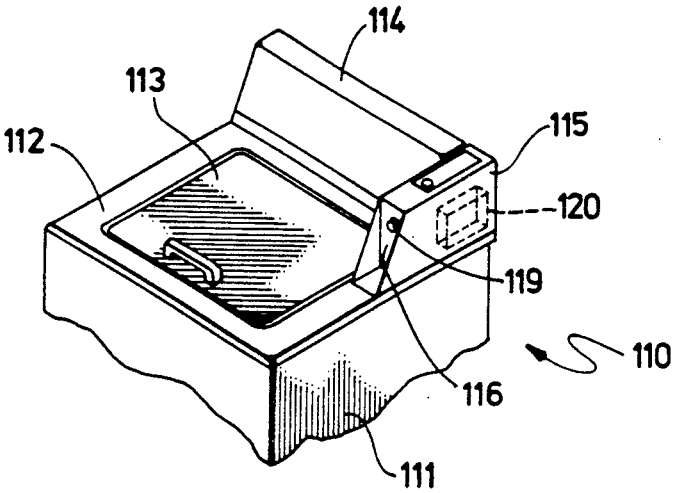
FIG. 8 is a partial isometric view of yet another fabric washing machine embodiment having a token actuated timer.

Turning now to FIG. 8, there is shown a fragmentary view of a commercial fabric washing machine 110 which may be actuated by a token or ticket. As shown in FIG. 8, this fabric washing machine 110 is also housed within a generally rectangular cabinet 111 having a generally horizontally disposed top cover 112 incorporating a pivotable access door or lid 113 for providing access to the interior of the fabric washing machine 110. A housing 114 extends generally upwardly from the rear of the top cover 112. Located on one side of the housing 114 is a generally rectangular vault structure 115 which extends forwardly along the side of the top cover 112. The vault structure 115 includes a generally vertically disposed face plate 116 for mounting a ticket or token receiver 119. An electromechanical timer 120, indicated by dashed lines in FIG. 8, controls the sequential operation of the fabric washing machine 110 through a plurality of events comprising a predetermined cycle of operations. As further shown in FIG. 8, in this particular embodiment, there is no protruding timer knob available for manually advancing the timer 120 through its cycle of operations or for positioning the timer cams in a cycle start posture.

Figure 9:
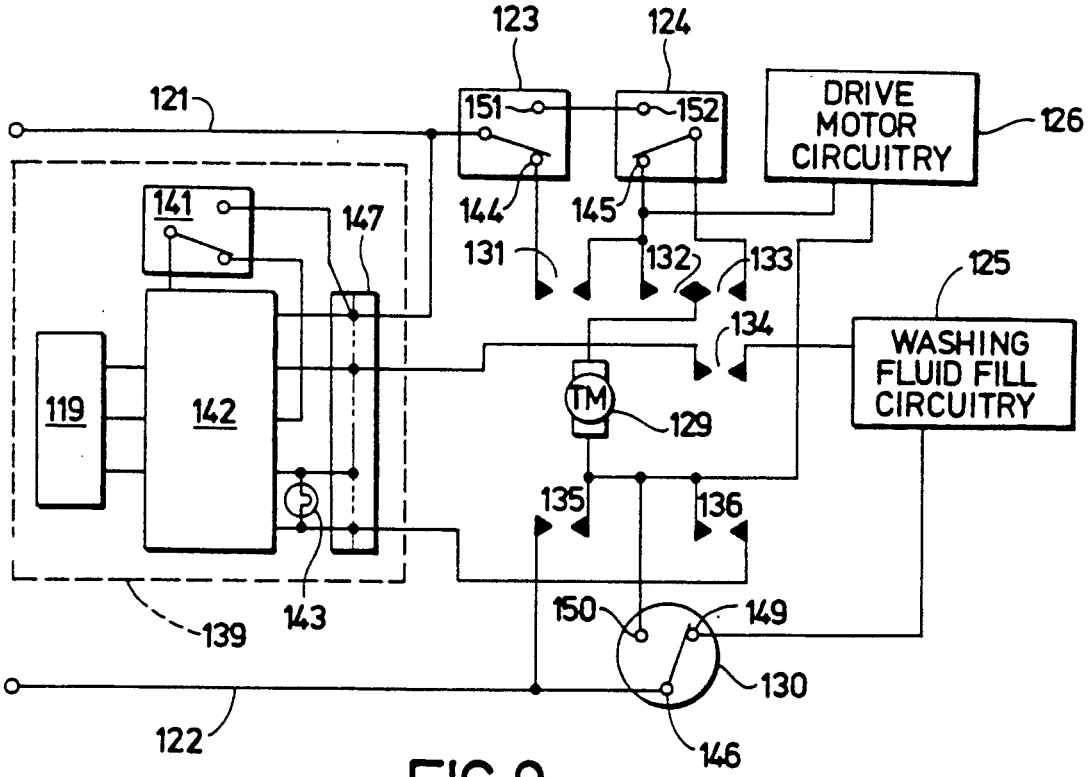
FIG. 9 is a schematic drawing of the operational circuitry for the fabric washing machine embodiment shown in FIG. 8.

FIG. 9 best shows a partial schematic circuit for the token actuated fabric washing machine 110 of FIG. 8. The circuit includes a source of power as provided by standard 120 VAC between conductors 121 and 122. The circuit further includes a single-pole double-throw lid switch 123, a single-pole double-throw switch 124, washing fluid fill circuitry 125, drive motor circuitry 126, a timer drive motor 129, a pressure actuated washing fluid level switch 130, timer cam switches 131–136 and a token or ticket control system 139.

The fabric washing machine 110 of FIG. 8 utilizes a switch actuating and unbalance mechanism and a switch mounting bracket as previously described with drawing FIGS. 2–5 and identified therein by numerals 25 and 40 respectively. Further, the single-pole double-throw lid switch 123 and the single-pole double-throw switch 124 in FIG. 9 directly interchange with previously described single-pole single-throw lid switch 59 and single-pole double-throw switch 60 on the switch mounting bracket 40.

During an unbalance situation, the lid switch 123 will be moved to the second conductive posture at contact 151 interrupting power to the drive motor circuitry 126 and the timer motor 129. Switch 124 will remain in the first conductive posture at contact 145. The unbalance mechanism is reset by opening and reclosing the lid 113 shown in FIG. 8. This action will return the lid switch 123 to contact 144 and allow the cycle of operations to continue.

Included in the ticket control system 139 is the ticket or token receiver 119, a start switch 141 and electronic circuitry 142 including a heat lamp 143 for destroying tickets after a single usage. The ticket control system 139 provides for initiating operation of the fabric washing machine 110 with a ticket or token and includes various safeguards to prevent actuation with a counterfiet token or ticket. Following insertion of a valid ticket, for example, into the receiver 119, the fabric washing machine 110 will be actuated by means of a circuit completed through the ticket control system 139. The ticket control system 139 is interfaced with the remainder of the circuitry of FIG. 9 by connector 147. A complete and detailed explanation of the operation of the ticket control system 139 is disclosed in U.S. Pat. No. 3,685,626 issued to Curran D. Cotton on Aug. 22, 1972 and assigned to the assignee of the instant invention.

An object of the instant invention is to provide a control system for a fabric washing machine wherein the non-manual, automatic conditioning of the timer 120 for actuation of a cycle of operations is dependent on operation of the lid switch 123 from a first conductive posture to a second conductive posture. The following description of the circuitry of FIG. 9 will explain how this and other objects are achieved in a fabric washing machine 110 which has no provision for an operator to manually advance the cam stack of the timer 120 to a cycle start posture.

The drive motor circuitry 126 includes, as previously indicated in FIG. 6, start and run windings, speed switch, overload protector and timer switches operated by timer cams driven by the timer drive motor 129.

In this embodiment of the invention, the washing fluid fill circuitry 125 is energized through timer cam switch 134 and the ticket control system 139 as soon as a ticket has been inserted into the receiver 119, verified by the electronic circuitry 142 and if the timer 120 is in a cycle start posture. Immediate energization of the fluid fill circuitry 125 is desirable in a commercial fabric washing machine 110 so that the customer perceives that the appliance is going to operate. This filling may begin with the lid 113 open or closed and thus with lid switch 123 made to either contact 144 or 151.

The circuitry of FIG. 9 is arranged so that when the lid 113 is closed, switches 123 and 124 will be made to contacts 144 and 145 respectively. Once the fluid level switch 130 has been satisfied, the switch arm 146 will move from the empty contact 149 to the full contact 150. Timer cam switches 131 and 132 will also be in a closed posture. The timer motor 129 can now advance through the cycle of operations.

Once the end of the cycle of operations has been achieved, the fabric washing machine 110 cannot be started again until a predetermined sequence of events has taken place. First, the lid 113 must be opened to move switches 123 and 124 to contacts 151 and 152 respectively. The timer motor 129, powered through closed timer cam switches 133 and 135 will advance and close timer cam switch 136 to provide power to the ticket control system 139. Next, the timer motor 129, powered through the ticket control system 139 and timer cam switch 135, continues to advance and closes timer cam switch 131. When the lid 113 is again closed, the lid switch 123 will be made to contact 144 supplying power to the drive motor circuitry 126 through timer cam switch 131 and to timer motor 129. In this embodiment, the timer motor 129 requires a 30 second time increment with the lid 113 open and switches 123 and 124 made to contacts 151 and 152 to advance the cam stack of timer 120 to the start position for a new cycle of operations. It can thus be readily seen that the circuitry of FIG. 9 provides for checking the operability of the lid switch 123 by requiring that the lid switch 123 operate between contacts 144 and 151 when the lid 113 is opened at the end of a cycle and then closed for a new cycle. This operation must occur for the next cycle of operations to begin. If the lid switch 123 does not mechanically operate to contact 151 and the timer motor 129 does not advance, it will be apparent to the operator that there has been a failure of the lid switch 123 since the fabric washing machine cannot be operated.

The switch 124 is provided, in this embodiment, so that if, for example, the lid 113 is opened during the last spin of the cycle of operations, the timer motor 129 will be energized through timer cam switches 133 and 135 to time out and will advance to condition the fabric washing machine 110 for the next cycle without powering the drive motor circuitry 126. Utilizing switch 124 creates two paths to the timer motor 129 with the drive motor circuitry 126 being bypassed with the lid 113 open.

It is thus apparent that the control system of FIG. 9 is useful in a fabric washing machine where the timer cannot be mechanically or manually advanced through its cycle of operations. If, at the end of the cycle of operations, the lid switch is not moved from a first contact to a second contact as by opening the lid, the timer cannot be conditioned for initiating a new cycle of operations. Thus, a check of the operability of the lid switch contacts is performed since the lid switch must be operable to both conductive paths for the appliance to be operable.

In the drawings and specification, there has been set forth a preferred embodiment of the invention and although specific terms are employed, these are used in a generic and descriptive sense only and not for purposes of limitation. Changes in the form and proportion of parts as well as the substitution of equivalents are contemplated as circumstances may suggest or render expedient without departing from the spirit or scope of the invention as further defined in the following claims.

I claim:

1. A control system for a fabric washing machine having a movable lid for providing access to a tub assembly, comprising: program control means for controlling said fabric washing machine through a predetermined cycle of operations, said program control means having a first state at which said cycle of operations may be initiated and a second state upon completion of said cycle of operations; power supply means for said fabric washing machine and said program control means; switch means in circuit with said power supply means and said program control means, said switch means actuatable between a first conductive posture with said lid in a first condition and a second conductive posture with said lid in a second condition; first circuit means connected with said first conductive posture for energizing said program control means in said first state to control said fabric washing machine through said cycle of operations and to terminate operation thereof with said program control means in said second state upon completion of said cycle of operations; second circuit means connected to said second conductive posture and operable with said program control means in said second state and said lid in said second condition for initiating modification of said program control means to said first state to condition said program control means for initiation of a new cycle of operations whereby operability of said switch means to said second conductive posture is a prerequisite to initiating a new cycle of operations.

2. A control system as defined in claim 1 wherein said switch means is operable from said first to said second conductive posture responsive to opening said lid for energizing said second circuit means and advancement of said program control means from said second state to said first state.

3. A control system as defined in claim 2 wherein failure of said switch means to operate to said second conductive posture upon opening of said lid will prevent said conditioning of said program control means and preclude the initiation of a new cycle of operations.

4. A control system as defined in claim 1 and further including housing means for enclosing said program control means and effectively preventing manual modification of the state of said program control means after completion of said cycle of operations.

5. A control system as defined in claim 1 wherein said switch means must be made to said second conductive posture for a predetermined time period to condition said program control means for initiation of a new cycle of operations.

6. A control system for a fabric washing machine having a movable lid for providing access to a tub assembly, comprising: program control means for controlling said fabric washing machine through a predetermined cycle of operations; power supply means for said fabric washing machine and said program control means; structure associated with said fabric washing machine for preventing manual advancement of said program control means; switch means in circuit with said power supply means and said program control means, said switch means actuatable between a first conductive path and a second conductive path responsive to movement of said lid between closed and open postures respectively; first circuit energizing means associated with said program control means and in circuit with said first conductive path of said switch means for normally controlling said fabric washing machine through said cycle of operations; and second circuit energizing means associated with said program control means and in circuit with said second conductive path of said switch means upon completion of said cycle of operations for initiating modification of said program control means to condition said program control means for initiation of a new cycle of operations whereby opening of said lid and operability of said switch means to said second conductive path are prerequisites to initiating a new cycle of operations.

7. A control system as defined in claim 6 wherein said switch means includes first and second switches actuatable between first and second conductive paths responsive to movement of said lid between closed and open postures respectively.

8. A control system as defined in claim 7 wherein the second conductive paths of said first and second switches are in series connection and provide said second circuit energizing means to said program control means isolated from said first circuit energizing means.

* * * * *